US009580814B2

(12) United States Patent
Jian et al.

(10) Patent No.: US 9,580,814 B2
(45) Date of Patent: Feb. 28, 2017

(54) CHEMICAL CONVERSION COATING AND METHOD OF FABRICATING THE SAME

(71) Applicant: National Taiwan University, Taipei (TW)

(72) Inventors: Shun-Yi Jian, Taoyuan County (TW); Kao-Feng Lin, New Taipei (TW); Yu-Ren Chu, Taipei (TW); Chao-Sung Lin, Taipei (TW)

(73) Assignee: National Taiwan University, Taipei (TW)

( * ) Notice: Subject to any disclaimer, the term of this patent is extended or adjusted under 35 U.S.C. 154(b) by 297 days.

(21) Appl. No.: 14/197,231

(22) Filed: Mar. 5, 2014

(65) Prior Publication Data

US 2015/0191826 A1 Jul. 9, 2015

(30) Foreign Application Priority Data

Jan. 6, 2014 (TW) ..... 103100417 A

(51) Int. Cl.

| | |
|---|---|
| ***C23C 22/18*** | (2006.01) |
| ***C23C 22/57*** | (2006.01) |
| ***C23C 22/73*** | (2006.01) |
| *C23C 22/07* | (2006.01) |

(52) U.S. Cl.

CPC ..... *C23C 22/57* (2013.01); *C23C 22/18* (2013.01); *C23C 22/73* (2013.01); *Y10T 428/265* (2015.01)

(58) Field of Classification Search

CPC ..... C23C 22/18; C23C 22/57; C23C 22/73; C23C 2222/00; C23C 22/364

USPC ..... 148/275

See application file for complete search history.

(56) References Cited

U.S. PATENT DOCUMENTS 6,485,580 B1 * 11/2002 Nakada ..... C23C 22/34 106/14.12

2002/0174915 A1 * 11/2002 Futsuhara ..... C23G 1/10 148/254

OTHER PUBLICATIONS

Wanqiu Zhou et al., "Structure and formation mechanism of phosphate conversion coating on die-cast AZ91D magnesium alloy," Corrosion Science, Sep. 7, 2007, pp. 329-337.

H. Umehara et al., "Structure and Corrosion Behavior of Conversion Coatings on Magnesium Alloys," Materials Science Forum, vols. 350-351, 2000, Trans Tech Publications, Switzerland, pp. 273-282.

Jan Ivar Skar and Darryl Albright, "Phosphate Permanganate: A Chrome Free Alternative for Magnesium Pre-treatment," Magnesium Alloys and their Applications, Sep. 20, 2000, pp. 1-6.

Hiroyuki Umehara et al., "An Investigation of the Structure and Corrosion Resistance of Permanganate Conversion Coatings on AZ91D Magnesium Alloy," Materials Transactions, vol. 42, No. 8, May 10, 2001, pp. 1691-1699.

H. Umehara et al., "Permanganate Conversion Coatings for Magnesium Alloys," Materials Science Forum, vols. 419-422, Mar. 15, 2003, pp. 883-888.

(Continued)

*Primary Examiner* — Lois Zheng

(74) *Attorney, Agent, or Firm* — Jianq Chyun IP Office

(57) ABSTRACT

A chemical conversion coating is provided. The chemical conversion coating is disposed on a surface of a magnesium alloy substrate. The chemical conversion coating includes a first protecting layer. The first protecting layer contains manganese, magnesium and oxygen, and a manganese content of the first protecting layer is between 10 at. % to 20 at. %.

10 Claims, 2 Drawing Sheets

(56) References Cited

OTHER PUBLICATIONS

Wang Guixiang et al., "Molybdate and molybdate/permanganate conversion coatings on Mg-8.5Li alloy," Applied Surface Science, Oct. 31, 2011, pp. 2648-2654.
C. S. Lin et al., "Formating of Phosphate/Permanganate Conversion Coatings on AZ31 Magnesium Alloy," Journal of The Electrochemical Society, Jan. 25, 2006, pp. B90-B96.
I. Danilidis et al., "Effects of inorganic additions on the performance of manganese-based conversion treatments," Corrosion Science, Sep. 28, 2006, pp. 1559-1569.
Y. L. Lee et al., "Effect of permanganate concentration on the formation and properties of phosphate/permanganate conversion coating on AZ31 magnesium alloy," Corrosion Science, Jan. 16, 2013, pp. 74-81.
Kwo Zong Chong and Teng Shih Shih, "Conversion-coating treatment for magnesium alloys by a permanganate-phosphate solution," Materials Chemistry and Physics, Sep. 19, 2002 pp. 191-200.
R.F. Zheng and C.H. Liang, "Conversion coating treatment for AZ91 magnesium alloys by a permanganate-REMS bath," Materials and Corrosion, vol. 58, Issue 3, Mar. 5, 2007, pp. 193-197.
H. Umehara et al., "Chrome-free surface treatments for magnesium alloy," Surface & Coatings Technology, vols. 169-170, Jun. 2, 2003, pp. 666-669.
David Hawke et al., "A Phosphate-Permanganate Conversion Coating for Magnesium," Metal Finishing, Oct. 1995, pp. 1-4.
Ming Zhao et al., "A chromium-free conversion coating of magnesium alloy by a phosphate-permanganate solution," Surface & Coatings Technology, Sep. 9, 2005, pp. 5407-5412.
F. Zucchi et al., "Stannate and permanganate conversion coating on AZ31 magnesium alloy," Corrosion Science, Jul. 27, 2007, pp. 4542-4552.
C.S. Lin and Y.C. Fu, "Characterization of Anodic Films on AZ31 Magnesium Alloys in Alkaline Solutions Containing Fluoride and Phosphate Anions," Journal of The Electrochemical Society, vol. 153, Issue 10, Aug. 8, 2006, pp. B417-B424.

* cited by examiner

CHEMICAL CONVERSION COATING AND METHOD OF FABRICATING THE SAME

CROSS-REFERENCE TO RELATED APPLICATION

This application claims the priority benefit of Taiwan application serial no. 103100417, filed on Jan. 6, 2014. The entirety of the above-mentioned patent application is hereby incorporated by reference herein and made a part of this specification.

BACKGROUND OF THE INVENTION

Field of the Invention

The invention relates to a surface treatment of magnesium alloys, and more particularly, to a chemical conversion coating and a method of fabricating the same.

Description of Related Art

Magnesium alloys have many advantages, such as light weigh, ease of processing, high strength, anti-electromagnetic interference and recyclability. Recently, for example, in the industrial design of 3C products, because of the requirements of lighter weight and texture design, the magnesium alloys have been widely used, for example, in casings of notebook computers, mobile phones and other electronic products.

However, since the magnesium alloys have poor corrosion resistance to etchants of the external environment, the development and applications of the magnesium alloys are significantly restricted. Accordingly, how to improve the corrosion resistance of a magnesium alloy substrate has become an important issue for today's technology.

SUMMARY OF THE INVENTION

The invention provides a chemical conversion coating having a manganese content between 10 at. % to 20 at. %.

The invention provides a method of fabricating a chemical conversion coating, which performs a chemical conversion coating treatment to a magnesium alloy substrate by using an inorganic acid chemical conversion solution having a pH value equal to or less than 2.

The invention provides a chemical conversion coating which is disposed on a surface of a magnesium alloy substrate. The chemical conversion coating includes a first protecting layer. The first protecting layer contains manganese, magnesium and oxygen, in which a manganese content of the first protecting layer is between 10 at. % to 20 at. %.

According to an embodiment of the invention, in the chemical conversion coating, a thickness of the first protecting layer is, for example, between 200 nm to 300 nm.

According to an embodiment of the invention, in the chemical conversion coating, a magnesium content of the first protecting layer is, for example, between 15 at. % to 25 at. %.

According to an embodiment of the invention, in the chemical conversion coating, an oxygen content of the first protecting layer is, for example, between 60 at. % to 70 at. %.

According to an embodiment of the invention, in the chemical conversion coating, a material of the first protecting layer includes $MnO_2$, $Mg(OH)_2$ and MgO.

According to an embodiment of the invention, the chemical conversion coating further includes a second protecting layer. The second protecting layer is disposed between the magnesium alloy substrate and the first protecting layer.

According to an embodiment of the invention, in the chemical conversion coating, a sum of thicknesses of the first protecting layer and the second protecting layer is, for example, between 300 nm to 500 nm.

According to an embodiment of the invention, in the chemical conversion coating, a material of the second protecting layer includes $Mg(OH)_2$ and MgO.

According to an embodiment of the invention, in the chemical conversion coating, a material of the magnesium alloy substrate is, for example, a Mg/Li/Zn alloy, a Mg/Al/Mn alloy and a Mg/Al/Zn alloy.

An embodiment of the invention provides a method of fabricating a chemical conversion coating, which includes the following steps. An inorganic acid chemical conversion solution is provided. The inorganic acid chemical conversion solution includes a permanganate and a pH value adjuster, in which a pH value of the inorganic acid chemical conversion solution is equal to or less than 2. A chemical conversion coating treatment is performed to a magnesium alloy substrate by the inorganic acid chemical conversion solution so as to form a first protecting layer on a surface of the magnesium alloy substrate. A manganese content of the first protecting layer is between 10 at. % to 20 at. %.

According to an embodiment of the invention, in the method of fabricating the chemical conversion coating, the permanganate is, for example, $KMnO_4$.

According to an embodiment of the invention, in the method of fabricating the chemical conversion coating, where in the inorganic acid chemical conversion solution, a concentration of the permanganate is, for example, between 0.09 M to 0.15 M.

According to an embodiment of the invention, in the method of fabricating the chemical conversion coating, the pH value adjuster is, for example, $H_2SO_4$. A concentration range of $H_2SO_4$ in the inorganic acid chemical conversion solution is, for example, between 0.08 M to 0.12 M.

According to an embodiment of the invention, in the method of fabricating the chemical conversion coating, a pH value of the inorganic acid chemical conversion solution is, for example, between 0.5 to 1.5.

According to an embodiment of the invention, in the method of the fabricating the chemical conversion coating, where in the process of the chemical conversion coating treatment, a second protecting layer is formed between the magnesium alloy substrate and the first protecting layer.

According to an embodiment of the invention, in the method of fabricating the chemical conversion coating, a sum of thicknesses of the first protecting layer and the second protecting layer is, for example, between 300 nm to 500 nm.

According to an embodiment of the invention, in the method of fabricating the chemical conversion coating, an operating time of the chemical conversion coating treatment is, for example, between 5 seconds to 15 seconds.

According to an embodiment of the invention, in the method of fabricating the chemical conversion coating, the pH value adjuster is $KH_2PO_4$. A concentration range of $KH_2PO_4$ in the inorganic acid chemical conversion solution is, for example, between 0.01 M to 0.035 M. The inorganic acid chemical conversion solution further includes a manganese ion additive.

According to an embodiment of the invention, in the method of fabricating the chemical conversion coating, a pH value of the inorganic acid chemical conversion solution is, for example, between 1.5 to 1.9.

According to an embodiment of the invention, in the method of the chemical conversion coating, the manganese ion additive is, for example, $Mn(NO_3)_2$.

According to an embodiment of the invention, in the method of the chemical conversion coating, where in the inorganic acid chemical conversion solution, a concentration of the manganese ion additive is, for example, between 0.20 M to 0.30 M.

According to an embodiment of the invention, in the method of fabricating the chemical conversion coating, a thickness of the first protecting layer is, for example, between 200 nm to 300 nm.

According to an embodiment of the invention, in the method of fabricating the chemical conversion coating, an operating time of the chemical conversion coating treatment is, for example, between 30 seconds to 90 seconds.

According to an embodiment of the invention, in the method of fabricating the chemical conversion coating, an operating temperature of the chemical conversion coating treatment is, for example, between 20° C. to 40° C.

According to an embodiment of the invention, in the method of fabricating the chemical conversion coating, a material of the magnesium alloy substrate is, for example, a Mg/Li/Zn alloy, a Mg/Al/Mn alloy and a Mg/Al/Zn alloy.

In the invention, the pH value of the inorganic acid chemical conversion solution used for fabricating the chemical conversion coating is equal to or less than 2, thereby the manganese content of the chemical conversion coating is between 10 at. % to 20 at. %. Since the manganese content of the chemical conversion coating is between 10 at. % to 20 at. %, the chemical conversion coating located on the magnesium alloy substrate can have a thickness just equal to or less than 500 nm, such that the chemical conversion coating has sufficient conductivity and adhesion. Furthermore, as the chemical conversion coating located on the magnesium alloy substrate has the thickness just equal to or less than 500 nm, the magnesium alloy substrate can, at the same time, achieve a better corrosion resistance and meet the demand for light weight.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
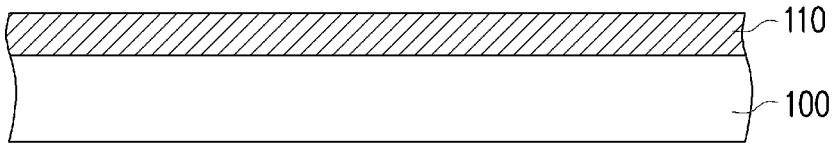
FIG. 1 is a schematic cross-sectional view of a chemical conversion coating according to an embodiment of the invention.

FIG. 1 is a schematic cross-sectional view of a chemical conversion coating according to an embodiment of the invention. Please refer to FIG. 1, a chemical conversion coating is disposed on a surface of a magnesium alloy substrate 100 as a protecting layer of the magnesium alloy substrate 100. A material of the magnesium alloy substrate 100 is, for example, a Mg/Li/Zn alloy, a Mg/Al/Mn alloy and a Mg/Al/Zn alloy. In the embodiments of the invention, the Mg/Li/Zn alloy is, for example, LZ91 of a dual-phase alloy structure. The Mg/Al/Mn alloy is, for example, AM30 of a single-phase alloy structure. The Mg/Al/Zn alloy is, for example, AZ31 of a single-phase alloy structure. It should be mentioned that, the LZ91 has good processing formability, therefore it has been widely used in industrial design of products demanding high texture, for instance, casings of mobile phones.

In the embodiment, the chemical conversion coating is a single-layer structure, i.e. a first protecting layer 110. The first protecting layer 110 contains manganese, magnesium and oxygen, in which a manganese content is between 10 at. % to 20 at. %. Furthermore, in the first protecting layer 110, a magnesium content is, for example, between 15 at. % to 25 at. %, and an oxygen content is, for example, between 60 at. % to 70 at. %. For example, a material of the first protecting layer 110 includes $MnO_2$, $Mg(OH)_2$ and MgO.

In the embodiment, the manganese content of the first protecting layer 110 is between 10 at. % to 20 at. %, so that the first protecting layer 110 is sufficient dense. Therefore, the surface of the magnesium alloy substrate is effectively protected by the first protecting layer 110, so as to avoiding corrosion from the etchants (for example, various acid liquids or air) of the external environment.

Furthermore, in the embodiment, a thickness of the first protecting layer 110 is, for example, between 200 nm to 300 nm. Namely, the first protecting layer 110 has a very thin thickness. Since the first protecting layer 110 has the thickness just between 200 nm to 300 nm, the first protecting layer 110 has sufficient high conductivity and high adhesion. Also, the magnesium alloy substrate 100 where the first protecting layer 110 located on meets the demand of light weight.

Figure 2:
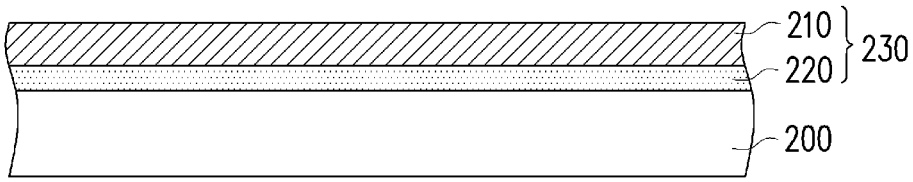
FIG. 2 is a schematic cross-sectional view of a chemical conversion coating according to another embodiment of the invention.

FIG. 2 is a schematic cross-sectional view of a chemical conversion coating according to another embodiment of the invention. Referring to FIG. 2, in the embodiment, a chemical conversion coating 230 disposed on a surface of a magnesium alloy substrate 200 is a double-layer structure. Namely, the chemical conversion coating 230 includes a first protecting layer 210 and a second protecting layer 220. The second protecting layer 220 is disposed between the magnesium alloy substrate 200 and the first protecting layer 210. The first protecting layer 210 is similar to the first protecting layer 110 of FIG. 1. The first protecting layer 210 contains manganese, magnesium and oxygen, in which a manganese content is between 10 at. % to 20 at. %. A magnesium content is, for example, between 15 at. % to 25 at. %. An oxygen content is, for example, between 60 at. % to 70 at. %. A material of the first protecting layer 210 includes, for example, $MnO_2$, $Mg(OH)_2$ and MgO.

Similarly to the first protecting layer 110 of FIG. 1, since the manganese content of the first protecting layer 210 is between 10 at. % to 20 at. %, the first protecting layer 210 is sufficient dense so as to effectively protect the surface of the magnesium alloy substrate 200 from corrosion.

A material of the second protecting layer 220 includes $Mg(OH)_2$ and MgO. A sum of thicknesses of the first protecting layer 210 and the second protecting layer 220 is, for example, between 300 nm to 500 nm. For example, a thickness of the first protecting layer 210 is, for example, between 200 nm to 300 nm, and a thickness of the second protecting layer 220 is, for example, between 100 nm to 200 nm.

In the embodiment, the chemical conversion coating 230 (consists of the first protecting layer 210 and the second protecting layer 220) has the very thin thickness (between 300 nm to 500 nm), so the chemical conversion coating 230 has sufficient high conductivity and sufficient high adhesion. Also, the magnesium alloy substrate 200 where the chemical conversion coating 230 located on meets the demand of light weight.

Figure 3:
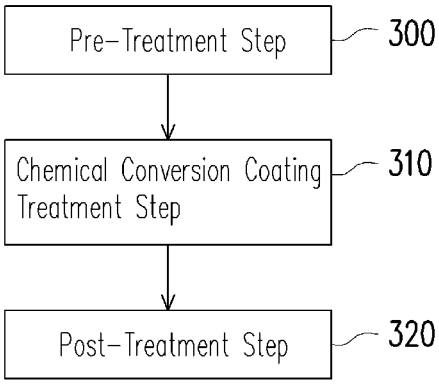
FIG. 3 is a flowchart illustrating a method of fabricating a chemical conversion coating according to an embodiment of the invention.

FIG. 3 is a flowchart illustrating a method of fabricating a chemical conversion coating according to an embodiment of the invention. Referring to FIG. 3, a method of fabricating a chemical conversion coating sequentially includes a pre-treatment step 300, a chemical conversion coating treatment step 310 and a post-treatment step 320.

First, in the pre-treatment step 300, dirt and native oxide on a surface of a magnesium alloy substrate is removed. A method of removing the dirt and the native oxide on the surface of the magnesium alloy substrate is, for example, using a basic treatment, an acid treatment and/or a de-ionized water cleaning process. Next, in the chemical conversion coating treatment step 310, the chemical conversion coating treatment is performed to the magnesium alloy substrate by an inorganic acid chemical conversion solution so as to form a first protecting layer on the surface of the magnesium alloy substrate. (A manganese content is between 10 at. % to 20 at. %.) The inorganic acid chemical conversion solution in the chemical conversion coating treatment step 310 includes a permanganate and a pH value adjuster, so as to have the inorganic acid chemical conversion solution of a pH value equal to or less than 2. Then, in the post-treatment step 320, the surface of the magnesium alloy substrate is cleaned with the de-ionized water and performing a drying treatment.

In the following, the chemical conversion coating of FIG. 1 and FIG. 2 are individually used to explicitly illustrate the method of fabricating the chemical conversion coating of the invention.

First Exemplary Embodiment

Referring to FIG. 1 and FIG. 3, first, in a pre-treatment step 300, dirt and native oxide on a surface of a magnesium alloy substrate 100 is removed. Next, a chemical conversion treatment step 310 is performed to the magnesium alloy substrate 100. In the embodiment, an inorganic acid chemical conversion solution used in the chemical conversion treatment step 310 includes a permanganate and a pH value adjuster. In addition, the inorganic acid chemical conversion solution further includes a manganese ion additive. A pH value of the inorganic acid chemical conversion solution is, for example, between 1.5 to 1.9. Furthermore, in the embodiment, the permanganate is, for example, $KMnO_4$, and a concentration thereof is, for example, between 0.09 M to 0.15 M. The pH value adjuster is, for example, $KH_2PO_4$, and a concentration thereof is, for example, between 0.01 M to 0.035 M. The manganese ion additive is, for example, $Mn(NO_3)_2$, and a concentration thereof is, for example, between 0.20 M to 0.30 M. In the embodiment, an operating time of the chemical conversion coating treatment step 310 is, for example, between 30 seconds to 90 seconds, and an operating temperature is, for example, between 20° C. to 40° C. After performing the chemical conversion coating treatment step 310, a first protecting layer 110 is formed on the surface of the magnesium alloy substrate 100. Then, the post-treatment step 320 is performed.

In the embodiment, when $KH_2PO_4$ serving as the pH adjuster so as to adjust the pH value of the inorganic acid chemical conversion solution to be between 1.5 to 1.9, heptavalent manganese ions of the permanganate and divalent manganese ions of the manganese ion additive undergo a redox reaction. In result, the first protecting layer 110 is formed on the surface of the magnesium alloy substrate 100, and the manganese content of the first protecting layer 110 is between 10 at. % to 20 at. %.

Second Exemplary Embodiment

Referring to FIG. 2 and FIG. 3, first, in a pre-treatment step 300, dirt and native oxide on a surface of a magnesium alloy substrate 200 is removed. Next, a chemical conversion treatment step 310 is performed to the magnesium alloy substrate 200. In the embodiment, an inorganic acid chemical conversion solution used in the chemical conversion treatment step 310 includes a permanganate and a pH value adjuster. A pH value of the inorganic acid chemical conversion solution is, for example, between 0.5 to 1.5. Furthermore, in the embodiment, the permanganate is, for example, $KMnO_4$, and a concentration thereof is, for example, between 0.09 M to 0.15 M. The pH value adjuster is, for example, $H_2SO_4$, and a concentration range thereof is, for example, between 0.08 M to 0.12 M. In the embodiment, an operating time of the chemical conversion coating treatment step 310 is, for example, between 5 seconds to 15 seconds, and an operating temperature is, for example, between 20° C. to 40° C. After performing the chemical conversion coating treatment step 310, a second protecting layer 220 and a first protecting layer 210 are sequentially formed on the surface of the magnesium alloy substrate 200. Then, the post-treatment step 320 is performed.

In the embodiment, when $H_2SO_4$ serving as the pH adjuster so as to adjust the pH value of the inorganic acid chemical conversion solution to be between 0.5 to 1.5, magnesium metal in the magnesium alloy substrate 200 and manganese ions of $KMnO_4$ undergo a redox reaction in the inorganic acid chemical conversion solution. In result, the second protecting layer 220 and the first protecting layer 210 are sequentially formed on the surface of the magnesium alloy substrate 200, and the manganese content of the first protecting layer 210 is between 10 at. % to 20 at. %.

In the invention, the pH value of the inorganic acid chemical conversion solution is sufficient low (equal to or less than 2), thus the operating time of the chemical conversion coating treatment is reduced to 5 seconds to 90 seconds.

Furthermore, in other embodiments of the invention, the pH value of the inorganic acid chemical conversion solution is less than 2, therefore the inorganic acid chemical conversion solution is capable of cleaning dirt and native oxide on the surface of the magnesium alloy substrate, and thereby omitting the pre-treatment step 300.

Experiment 1

The following experimental examples are used to further illustrate a method of fabricating a chemical conversion coating of the invention and an evaluation of properties of the chemical conversion coating.

Magnesium alloy substrate: LZ91

Operating temperature of the chemical conversion coating treatment: 25° C.

Operating time of the chemical conversion coating treatment: as shown in Table 1

Formula of an inorganic acid chemical conversion solution: as shown in Table 1 pH value of an inorganic acid chemical conversion solution: as shown in Table 1

<Evaluation of Adhesion>

According to subjects stipulated by ASTM D3359-02, each of the chemical conversion coatings (A1 to A5 and B1 to B5) in Table 1 undergoes a coating release testing. After the coating release testing, an adhesion level of each of the chemical conversion coatings is evaluating by the ASTM D3359-02 standard, and the results are shown in Table 1. In accordance with the ASTM D3359-02 standard, the adhesion levels are classified into 1B to 5B, where the higher the number, the better the adhesion. The highest level is 5B.

<Evaluation of Corrosion Resistance>

According to subjects stipulated by ASTM B117, each of the chemical conversion coatings (A1 to A5 and B1 to B5) in Table 1 is under a salt spray test by a sodium chloride aqueous solution at a concentration of 5 wt % for 12 hours. After the salt spray test, a corrosion resistance level of each of the chemical conversion coatings is evaluating by the ASTM D610-08 standard, and the results are shown in Table 1. In accordance with the ASTM D610-08 standards, the corrosion resistance levels are classified into 0 to 10, where the higher the number, the better the corrosion resistance.

TABLE 1

| No. | Formula of an inorganic acid chemical conversion solution | Magnesium alloy substrate | pH value | Operating time (seconds) | Operating Temperature | Adhesion level | Salt spraying time | Corrosion resistance level |
|---|---|---|---|---|---|---|---|---|
| A1 | 1. $KMnO_4$: 0.09M<br>2. $KH_2PO_4$: 0.01M<br>3. $Mn(NO_3)_2$: 0.025M | LZ91 | 1.56 | 30 | 25° C. | 5B | 12 hr. | 5 |
| A2 | 1. $KMnO_4$: 0.09M<br>2. $KH_2PO_4$: 0.02M<br>3. $Mn(NO_3)_2$: 0.025M | | 1.70 | 45 | | 5B | | 5 |
| A3 | 1. $KMnO_4$: 0.09M<br>2. $KH_2PO_4$: 0.03M<br>3. $Mn(NO_3)_2$: 0.025M | | 1.81 | 60 | | 5B | | 5 |
| A4 | 1. $KMnO_4$: 0.125M<br>2. $KH_2PO_4$: 0.035M<br>3. $Mn(NO_3)_2$: 0.025M | | 1.85 | 60 | | 5B | | 5 |
| A5 | 1. $KMnO_4$: 0.09M<br>2. $KH_2PO_4$: 0.035M<br>3. $Mn(NO_3)_2$: 0.025M | | 1.88 | 90 | | 5B | | 5 |
| B1 | $KMnO_4$: 0.09M<br>$H_2SO_4$(0.1M): 6.2 ml/L | LZ91 | 0.52 | 10 | 25° C. | 3B | 12 hr. | 5 |
| B2 | $KMnO_4$: 0.125M<br>$H_2SO_4$(0.1M): 6.2 ml/L | | 0.52 | 5 | | 3B | | 5 |
| B3 | $KMnO_4$: 0.09M<br>$H_2SO_4$(0.1M): 5.4 ml/L | | 1.04 | 5 | | 5B | | 5 |
| B4 | $KMnO_4$: 0.09M<br>$H_2SO_4$(0.1M): 4.4 ml/L | | 1.50 | 10 | | 5B | | 6 |
| B5 | $KMnO_4$: 0.09M<br>$H_2SO_4$(0.1M): 4.4 ml/L | | 1.50 | 10 | | 5B | | 6 |

According to Table 1, in the experimental examples A1 to A5 and B1 to B5, the corrosion resistance levels of the chemical conversion coatings are all equal to or greater than 5 (i.e., the percentage of a corrosion area is less than 3%). The corrosion resistance levels of the chemical conversion coatings in the experimental examples B4 and B5 are even up to 6 (i.e., the percentage of the corrosion area is less than 1% and greater than 0.3%). For general industrial uses, an evaluation of the corrosion resistance of a coating is excellent if the percentage of the corrosion area is less than 5% after 12-hour salt spray test. Therefore, the chemical conversion coating of the invention meets the need of the industries.

Furthermore, according to Table 1, besides the adhesion levels of the chemical conversion coatings of the experimental examples B1 and B2 are 3B (i.e., the percentage of a fall-off area is between 5~15%), the chemical conversion coating of the other experimental examples are all 5B (i.e., no fall-off). For general industrial uses, the adhesion of the chemical conversion coating of the invention is sufficient to meet the requirement.

Experiment 2

Evaluations of Thickness and Denseness

Figure 4:
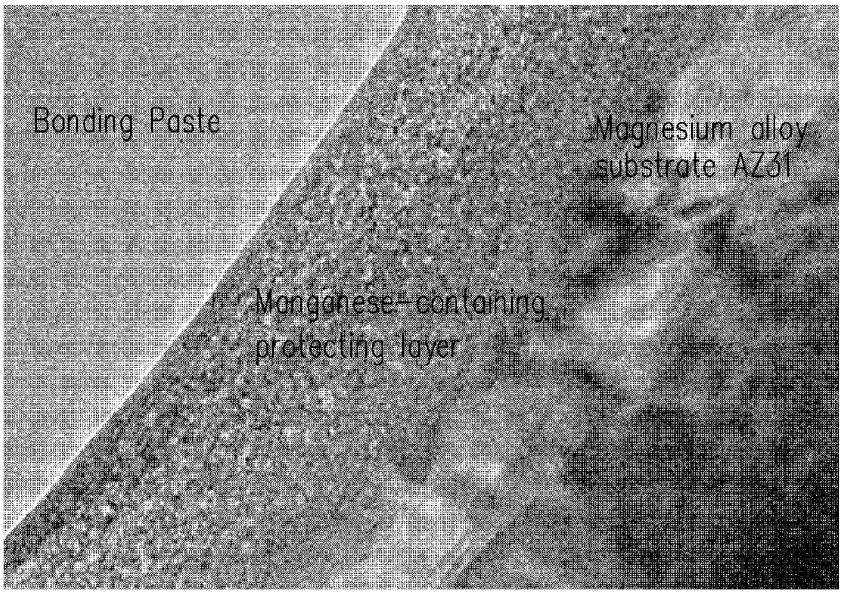
FIG. 4 is an electron micrograph of a cross-section of a chemical conversion coating according to an embodiment of the invention.
Figure 5:
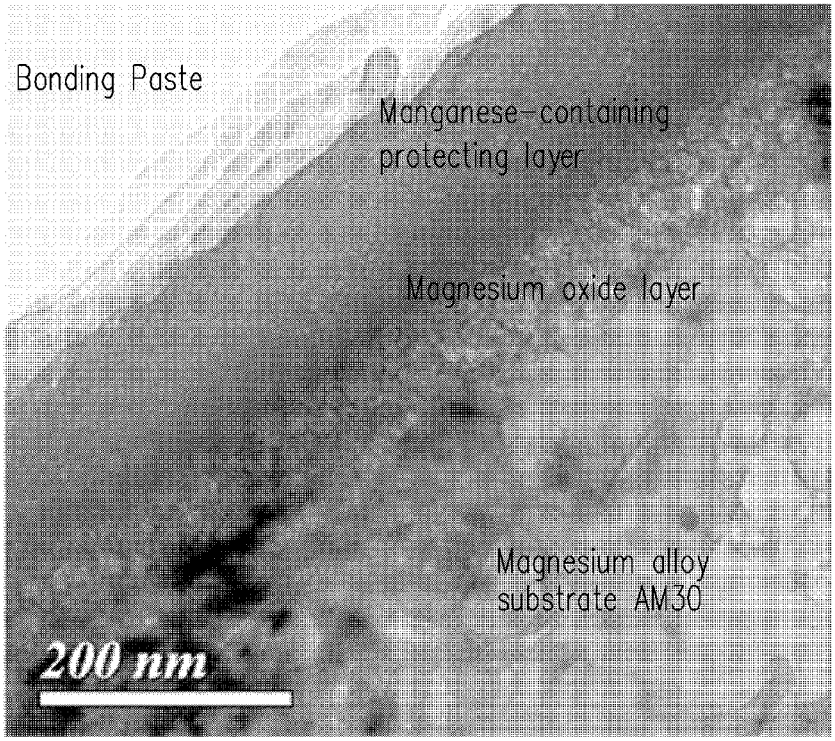
FIG. 5 is an electron micrograph of a cross-section of a chemical conversion coating according to another embodiment of the invention.

FIG. 4 and FIG. 5 are an electron micrograph of a cross-section of a chemical conversion coating according to AZ31 and AM30 serving as a magnesium alloy substrate, respectively. It can be seen that, in FIG. 4 and FIG. 5, the chemical conversion coating of the invention is much denser and has less pores.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. A method of fabricating a chemical conversion coating, comprising:

providing an inorganic acid chemical conversion solution, wherein the inorganic acid chemical conversion solution comprises a permanganate and a pH value adjuster, and a pH value of the inorganic acid chemical conversion solution is equal to or less than 1.88; and performing a chemical conversion coating treatment to a magnesium alloy substrate by the inorganic acid chemical conversion solution so as to form a first protecting layer on a surface of the magnesium alloy substrate, wherein a manganese content of the first protecting layer is between 10 at. % to 20 at. %, wherein the pH value adjuster is $KH_2PO_4$, a concentration range of $KH_2PO_4$ in the inorganic acid chemical conversion solution is between 0.01 M to 0.035 M, and the inorganic acid chemical conversion solution further comprises a manganese ion additive.

2. The method of fabricating a chemical conversion coating of claim 1, wherein the permanganate is $KMnO_4$.

3. The method of fabricating a chemical conversion coating of claim 1, wherein in the inorganic acid chemical conversion solution, a concentration of the permanganate is between 0.09 M to 0.15 M.

4. The method of fabricating a chemical conversion coating of claim 1, where the pH value of the inorganic acid chemical conversion solution is between 1.5 and 1.88.

5. The method of fabricating a chemical conversion coating of claim 1, where the manganese ion additive is $Mn(NO_3)_2$.

6. The method of fabricating a chemical conversion coating of claim 5, wherein in the inorganic acid chemical conversion solution, a concentration of the manganese ion additive is between 0.20 M to 0.30 M.

7. The method of fabricating a chemical conversion coating of claim 1, wherein a thickness of the first protecting layer is between 200 nm to 300 nm.

8. The method of fabricating a chemical conversion coating of claim 1, wherein an operating time of the chemical conversion coating treatment is between 30 seconds to 90 seconds.

9. The method of fabricating a chemical conversion coating of claim 1, wherein an operating temperature of the chemical conversion coating treatment is between 20° C. to 40° C.

10. The method of fabricating a chemical conversion coating of claim 1, wherein a material of the magnesium alloy substrate comprises a Mg/Li/Zn alloy, a Mg/Al/Mn alloy and a Mg/Al/Zn alloy.

* * * * *